United States Patent [19]

Landry

[11] 4,365,215

[45] Dec. 21, 1982

[54] HIGH POWER COAXIAL POWER DIVIDER

[75] Inventor: Norman R. Landry, Mount Laurel, N.J.

[73] Assignee: RCA Corporation, New York, N.Y.

[21] Appl. No.: 226,711

[22] Filed: Jan. 21, 1981

[51] Int. Cl.[3] ..... H01P 5/12

[52] U.S. Cl. ..... 333/127; 338/216

[58] Field of Search ..... 333/127, 123, 136, 125; 338/7, 216

[56] References Cited

U.S. PATENT DOCUMENTS

| | | | |
|---|---|---|---|
| 3,091,743 | 5/1963 | Wilkinson . | |
| 3,246,262 | 4/1966 | Wichert | 333/24.1 X |
| 3,904,990 | 9/1975 | LaRosa . | |
| 4,163,955 | 8/1979 | Iden et al. . | |
| 4,263,568 | 4/1981 | Nemit | 333/127 |

OTHER PUBLICATIONS

Wilkinson, *An N-Way Hybrid Power Divider,* IRE Trans. on MTT, Jan. 1960, pp. 116–118.

Gysel, *A New N-Way Power Divider/Combiner Suitable for High Power Applications,* Proc. of 1975, IEEE MTT Seminar, pp. 116–118.

Parad et al., *Split-Tee Power Divider,* IEEE Trans. on MTT, Jan. 1965, pp. 91–95.

Excerpts from *Independent Research and Development Program* book of RCA Government Systems Division for 1979 dated Mar. 1979.

*Primary Examiner*—Paul L. Gensler

*Attorney, Agent, or Firm*—Samuel Cohen; Robert L. Troike; Robert Ochis

[57] ABSTRACT

The power handling capacity of a matched coaxial transmission line power divider is increased with a minimum increase in losses by mounting the isolation resistor(s) within the dielectric volume of the coaxial transmission line and on an electrically-insulating resistor contact portion of a thermally-conducting heat sink. A low dielectric constant region is located between the resistor contact portion of the heat sink and the directly adjacent portion of the outer conductor of the coaxial transmission line.

9 Claims, 6 Drawing Figures

HIGH POWER COAXIAL POWER DIVIDER

This invention is applicable to the field of high-frequency coupling structures and, more particularly, to the field of coaxial transmission line power dividers.

An ideal matched microwave power divider has a common port and a plurality of branch ports or lines and divides input power applied to the common port among the branch ports in a predetermined ratio and provides isolation between the branch ports in order that reflections and other disturbances in one of the branch lines will not affect other branch lines.

A coaxial transmission line power divider providing isolation between the branch ports is described in a paper by Ernest J. Wilkinson entitled, "An N-Way Hybrid Power Divider," which appeared in the January 1960 issue of the *IRE Transactions on Microwave Theory and Techniques* at pages 116–118 and is the subject of his U.S. Pat. No. 3,091,743. In this divider the common port inner conductor is expanded into a hollow shell as a transformer section. The hollow shell is slit lengthwise into as many equal width splines as the number (N) of branch ports desired. The slits and, thus, the splines are ¼ wavelength long at the designed operating frequency. A different isolation or odd mode power dissipation resistor is associated with each spline of the cylindrical shell. All of the resistors have the same value. Each resistor has a first end connected to the "free end" of its associated spline and a second end connected to the second ends of all the other resistors at a common floating junction. This resistor connection is referred to as a resistive star and may be considered an N-terminal resistance element. The "free ends" of the splines are also connected to the inner conductors of the branch lines or ports of the divider. This structure provides even power division among the branch ports while isolating the branch ports from each other. The isolation results from (1) the presence of the resistive star which dissipates odd mode power entering from one of the branch ports and (2) the quarter wavelength length of the splines which transforms the short circuit merger of the splines at the common port end of the splines into an open circuit appearance at the other end of the splines where the resistors are connected to the splines, thus maximizing the odd-mode voltage across the resistors for a given odd mode signal.

The Wilkinson divider was generalized for non-equal power division in an article entitled, "Split-Tee Power Divider" by Parad et al. at pages 91–95 of the *IEEE Transactions on Microwave Theory and Techniques* for January 1965. A strip line implementation of their design is illustrated in the article. In it the "splines" are of unequal width and the isolation resistors are of unequal values in order to provide uneven power division.

Both of the above structures suffer from the problem of having limited power handling capabilities due to limited conduction of heat away from the isolation resistors. In the Wilkinson structure the isolation resistors are suspended from the inner conductors. Thus, the inner conductors are the only available thermal conduction path for disposing of the heat generated by the resistor's dissipation of any odd mode power. These inner conductors do not provide good heat sinking. In the Parad et al. structure the odd-mode resistor contacts only the center conductor and the dielectric of the strip line, neither of which provides good heat sinking.

A technique overcoming these power limitations is disclosed in U.S. Pat. No. 3,904,990 to La Rosa. Transmission lines are used to space the odd mode resistors physically away from the "splines" of the divider. This allows high power resistors to be used with good heat sinking. This technique is also described in an article entitled, "A New N-Way Power Divider/Combiner Suitable for High Power Applications" by Gysel at pages 116–118 of the *Proceedings* of the 1975 IEEE Microwave Theories and Techniques Seminar. A strip line embodiment of this structure is mentioned in the article. Transmission lines are used to physically space the isolation resistors from the junctures of the inner conductor splines with their associated branch inner conductors. High power, grounded, heat sunk, external isolation resistors are matched to these transmission lines, thereby solving the heat dissipation problems of the earlier structures.

Iden et al. in U.S. Pat. No. 4,163,955 disclose a coaxial transmission line structure which uses this technique and steps and splines the common inner conductor to provide the impedance transformations needed in a many branch divider. The La Rosa, Gysel and Iden structures trade a problem of bulkiness for the power handling problems of the Wilkinson and Parad et al. structures.

Each of the above references is incorporated herein by reference.

High power coaxial transmission line power dividers are needed which are similar in size to low power dividers and have the same low loss characteristics or at least have only small increases in loss. This need is particularly acute in structures such as phased array antennas where many dividers are used and where small size and low weight are important for the overall structure.

In accordance with one embodiment of the present invention the above problems of the prior art are overcome by placing the isolation resistor(s) inside the outer conductor of the coaxial transmission line on an electrically insulating resistor contact portion of a low capacitance, high thermal conductivity heat sink. A region of low dielectric constant is disposed between the resistor contact portion of the heat sink and the directly adjacent portion of the outer conductor to minimize the capacitance between the resistor and the outer conductor in order to minimize even mode power dissipation.

Figure 1:
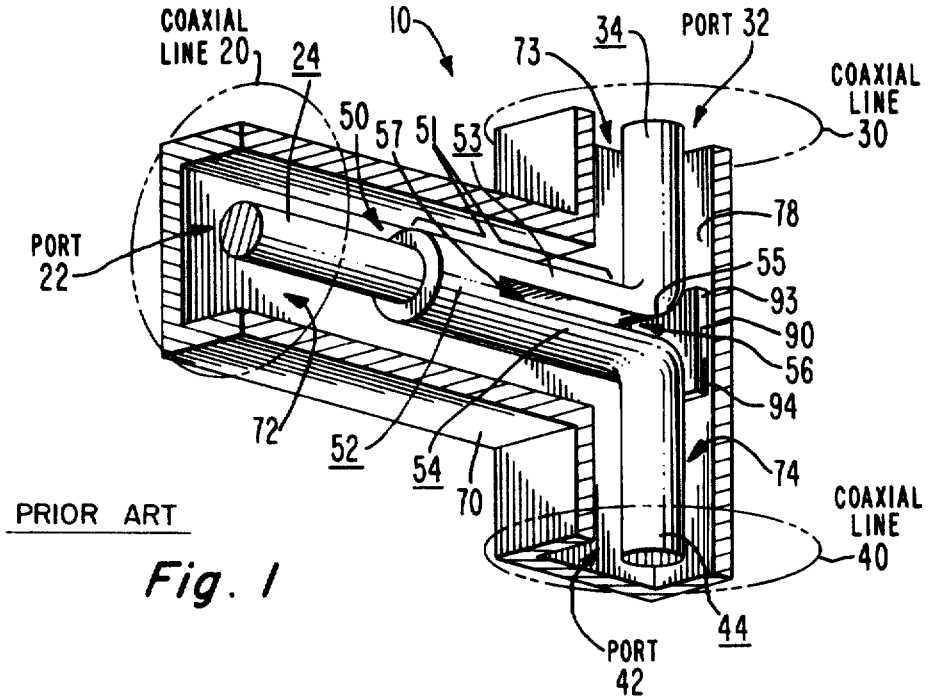
PRIOR ART Fig. 1
FIG. 1 is a perspective cutaway view of a prior art low-power, split-tee coaxial transmission line power divider.

A prior art low-power coaxial split-tee power divider 10 is illustrated in FIG. 1. This divider has a common coaxial transmission line 20 and two branch coaxial transmission lines 30 and 40. Common line 20 begins with a common port 22 of this coupling structure. Branch lines 30 and 40 end with branch ports 32 and 42, respectively, of this coupling structure. The common port 22 acts as the input port when power division is desired and as the output port when power combining is desired. Port 22 is common in the sense that it communicates with each of the branch ports. Branch ports 32 and 42 are isolated or decoupled from each other and act as output ports when power division is desired and as input ports when power combining is desired.

The divider 10 includes a rigid inner conductor system 50 which is coaxially enclosed by a rigid outer conductor 70 which is shown partially cutaway to expose the enclosed structure.

The inner conductor system 50 includes a common leg 24 connected to common port 22, two branch legs 34 and 44 and an impedance transforming and isolation enabling section 51 which connects the inner conductor common leg 24 to the two branch inner conductor legs 34 and 44. The inner conductor branch legs 34 and 44 connect to branch ports 32 and 42, respectively, and are usually co-linear with each other and perpendicular to common leg 24. Impedance transformer section 51 includes an enlarged common section 52 at its common leg end and two splines 53 and 54 which extend from the common section 52 to the transformer's branch end 55 where the splines 53 and 54 become the branch inner conductor legs 34 and 44, respectively. As far as power division is concerned, the branches effectively begin at the common end 57 of the slot 56 where splines 53 and 54 merge into common section 52. However, since the splines 53 and 54 have other important functions, the conductors 34 and 44 are identified as beginning at end 55 of transforming and isolating section 51.

The inner conductor system 50 is supported coaxially within the outer conductor 70 by dielectric spacing supports which are not shown.

Legs 24, 34 and 44 and common transformer portion 52 are preferably right circular cylinders. Splines 53 and 54 are spaced from each other by a slot or slit 56. The splines 53 and 54 together with the material removed to form slot 56 originally formed a right circular cylinder. The increased diameter of transformer section 51 reduces the characteristic impedance of the coaxial transmission line 20 to provide efficient, low VSWR coupling between the common line 20 and the branch lines 30 and 40 as is well known in the art.

An isolation or odd-mode power dissipation resistor 90 is connected from branch inner conductor 34 to branch inner conductor 44 near their junctures with the splines 53 and 54, respectively. As explained in the Wilkinson article cited above, the resistor 90 dissipates any odd mode power present but dissipates substantially no even mode power since, for even mode power, the opposite ends 93 and 94 of the resistor are at the same potential. The power handling capability of this prior art power divider is limited by the ability of the resistor 90 to dissipate odd mode power without overheating. Electrical contact between this resistor and the branch conductors 34 and 44 is preferably made exactly ¼ wavelength (at a frequency within the band) from the point 57 where the transformer's splines 53 and 54 emerge from common transformer section 52 since this maximizes the branch port to branch port isolation obtained. This contact can be made in many ways. Preferably it is made in a manner in which the contact configuration and location is tightly controlled to avoid variations which will affect the impedance match, losses and isolation.

The inner conductor common leg 24 and the transformer section 51 are located within a common channel 72 of the outer conductor. Branch leg inner conductor 34 is located within a channel 73 in the outer conductor and branch leg inner conductor 44 is located within a channel 74 in the outer conductor. The three outer conductor channels 72, 73 and 74 all have the same cross-sectional dimensions.

Figure 2:
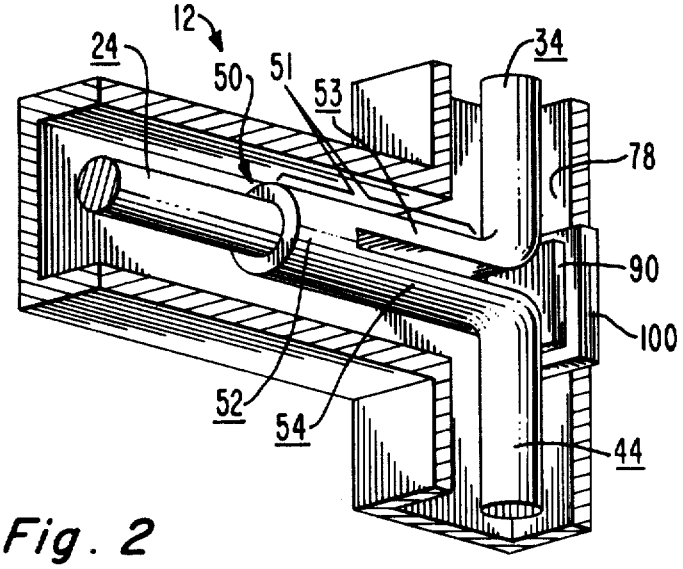
FIG. 2 is a perspective cutaway view of a higher-power, higher loss, split-tee coaxial transmission line power divider.

A power divider 12 in FIG. 2 is similar to prior art power divider 10 of FIG. 1 and the same reference numerals are used to identify corresponding portions of the device. The power handling capability of the FIG. 2 structure is increased by about a factor of 20 over that of the FIG. 1 structure by adding an electrically-insulating, thermally-conducting heat sink 100 to thermally couple the odd-mode resistor 90 to the surface 78 of the outer conductor 70. This heat sink 100 is preferably BeO which is both an excellent thermal conductor and an excellent electrical insulator. This substantially increases the power handling capability of the resistor by increasing the surrounding structure's ability to carry away the heat generated by the dissipation of odd mode power. Unfortunately, this type of high power split-tee is unexpectedly significantly more lossy than a low power split-tee in accordance with FIG. 1. This loss has now been determined to be caused by the relatively high dielectric constant of BeO (6.6). This induces a substantial capacitance (having a value $C_1$) between the resistor 90 and the outer conductor 70. For even mode power the voltage between the resistor 90 and the outer conductor wall 78 varies in unison with the RF voltage on the inner conductors where the resistor connects to them. Thus, the resistor 90 acts as one electrode of the capacitance $C_1$. As the voltage across it increases and decreases, the capacitance $C_1$ charges and discharges via displacement currents which must flow in its "electrode" resistor 90. The displacement current in the middle (end-to-end) of the capacitor must flow through half of resistor 90. The displacement currents which flow in resistor 90 cause even mode losses by dissipating part of their power within the resistor 90. Thus, the coaxial transmission line power divider of FIG. 2 provides an increase in power handling capability over that of the FIG. 1 prior art structure, but this increase has an attendant cost of an increase in loss.

Figure 3:
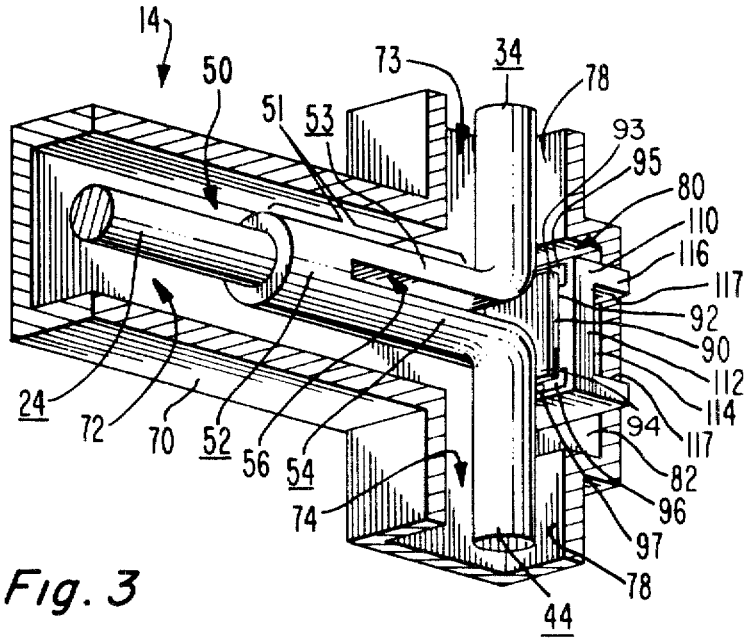
FIG. 3 is a perspective cutaway view of a low loss high-power coaxial transmission line split-tee power divider in accordance with the preferred embodiment of the present invention.

FIG. 3 illustrates a rigid, coaxial transmission line split-tee power divider 14 in accordance with the preferred embodiment of the present invention. This divider is similar to the dividers 10 and 12 of FIGS. 1 and 2 and the corresponding components have been numbered with the same reference numerals, with the exception of the heat sink for the odd-mode power dissipation resistor. Divider 14 differs from divider 12 of FIG. 2 because the heat sink (110) and the outer conductor are configured to place or provide a region 114 of low dielectric constant between the isolation resistor 90 and the outer conductor 70 to minimize the capacitance between the resistor 90 and the outer conductor 70. In the preferred embodiment of FIG. 3 this is accomplished by special contouring of both the heat sink and the outer conductor which now includes an alcove 80 where the outer conductor channels 73 and 74 of the branch legs merge with the channel 72 of the common leg. The alcove 80 is preferably positioned symmetrically with respect to the axis of the common line 20. A low capacitance, thermally-conducting heat sink 110 is disposed in the alcove 80.

Heat sink 110 has an electrically insulating, thermally conducting resistor contact portion 112 in thermally conducting contact with a high-power odd-mode power dissipation or isolation resistor 90.

Resistor 90 is preferably a high power, thick film resistor formed directly on the resistor contact portion 112 of heat sink 110 in order to obtain intimate thermal contact between the resistor and the heat sink. Preferably metallic terminals 95 and 96 are pre-deposited on heat sink 110 and resistor 90 is then deposited so that it overlaps and electrically contacts both terminals, with end 93 contacting terminal 95 and end 94 contacting terminal 96. Terminals 95 and 96 then serve as terminals for connecting the resistor to the inner conductors of the branch legs. The resistor 90 is covered with a passivating coating or layer which isolates it from the surrounding environment other than the terminals 95 and 96. Contact between the adjacent branch inner conductor and the contact terminals 95 and 96 may be made by using a conductive RTV (Room Temperature Vulcanizing rubber) in the form of a short cylinder 97 held in place by a mating socket (not shown) in the inner conductor 34 or 44.

The low dielectric constant region 114 is disposed between the resistor contacting portion 112 of the heat sink and the inner face 82 of outer conductor alcove 80 which is the directly adjacent portion of the outer conductor. In the case of a planar interface 92 between the resistor 90 and the resistor contact portion 112 of the heat sink, directly adjacent in this specification means that portion of the outer conductor which is on the same side of the inner conductor as the heat sink is and which is intercepted by perpendiculars to the plane of the interface which pass through the resistor 90. However, it is preferred that a larger portion of the outer conductor be spaced from resistor 90 by the low dielectric constant region in order to avoid strong fringing fields which can occur if only the directly adjacent portion of the outer conductor is so spaced. Preferably the low dielectric constant region spaces resistor 90 from a portion of the outer conductor 70 which is at least 3 or 4 times the area of the resistor.

The region 114 is preferably occupied by the coaxial line dielectric where the dielectric is a gas or a vacuum. However, if desired, a solid dielectric may be used.

In this embodiment the thickness of low dielectric constant region 114 is established by two standoffs 116 which give the heat sink 110 a rectangular arch configuration. Preferably standoffs 116 are dielectric. Resistor contact portion 112 and standoffs 116 preferably constitute a single continuous monolithic body of a high thermal conductivity dielectric such as BeO or alumina ($Al_2O_3$). The hollow 114 of the arch can be viewed as an alcove in a thicker heat sink having a thickness equal to the total height of the heat sink (resistor contact portion 112 plus standoffs 116). Heat sink 110 is preferably bonded directly to outer conductor 70 with solder.

Use of dielectric standoffs makes the length of the surface leakage path from the contact terminals 95 and 96 and from the resistor 90 to the outer conductor along the heat sink longer than it would be if conductive standoffs were used and longer than it is in the high power divider 12. This raises the breakdown voltage of this leakage path and thereby increases the peak power the divider can handle without breaking down. Doubling the length of the path doubles the breakdown voltage and quadruples the peak power.

The series combination of two dielectrics, the beryllium oxide of the resistor contact portion of the heat sink and the region of low dielectric between the resistor and the outer conductor acts like two capacitors in series—one having the BeO as its dielectric and the other having the dielectric of region 114. Where the resistor contact portion 112 has the same thickness as heat sink 100 in FIG. 2, the resistor contact portion 112 creates a capacitance equal to the capacitance $C_1$ of the FIG. 2 structure. The air or other low dielectric constant dielectric in the region 114 constitutes a second capacitance $C_2$ in series with the capacitance $C_1$. As is well known, the capacitance of a capacitance $C_1$ in series with a capacitance $C_2$ is $C_1C_2/(C_1+C_2)$. When one capacitor is substantially larger than the other, this expression reduces essentially to the capacitance of the smaller capacitor. Air has a dielectric constant of substantially 1. Thus, for substantially equal thicknesses of the dielectrics, the capacitance value of the air capacitor ($C_2$) will be (1/6.6) the value of the BeO capacitor ($C_1$). Thus, the air capacitor controls the capacitance between the resistor 90 and the outer conductor 70. The small capacitance value of the air capacitor restricts even mode displacement currents flowing through the odd mode load resistor 90 to very small values. As a consequence, the power handling capacity of the split-tee 14 in FIG. 3 is increased over the power handling capacity of the split-tee 10 in FIG. 1 without the increase in loss which is experienced by the split-tee 12 in FIG. 2. The power handling capacity of the split-tee 14 of FIG. 3 is slightly greater than that of the embodiment of FIG. 2 for the same resistor characteristics because very little or no even mode power is dissipated in the load resistor 90 in the embodiment of FIG. 3 and thus, more odd mode power can be dissipated by the resistor 90 in FIG. 3 without overheating than can be dissipated by the resistor 90 in FIG. 2.

The standoff portion 116 of the heat sink 110 is preferably laterally displaced from the resistor 90 to minimize even mode displacement currents in the resistor. That is, the inner or facing surfaces 117 of the individual legs of the standoff 116 are preferably spaced from each other by at least the length of the resistor 90 and positioned symmetrically with respect to the slot 56 and the resistor 90. In this way, the electric field lines which are induced by the high capacitance of these legs will aid in minimizing the heat sink's adverse effect on the even mode insertion loss because this large capacitance concentrates the available displacement current away from the resistor, thereby further limiting the even mode displacement current flow in the odd mode resistor.

Even with the air dielectric in the space 114, the heat sink 110 places a capacitance between the inner conductor of each branch leg and the outer conductor. These capacitances are primarily due to the standoffs 116. In order to obtain as low a VSWR as possible, a series capacitor-inductor-capacitor (CLC) tuned circuit is used to compensate for this capacitance. This circuit is designed to resonate within the designed operating band of the divider in order to minimize the net reactance seen by a propagating wave.

The inductors of the CLC circuits are formed by making the splines 53 and 54 a little thinner than they would be if the standoff capacitances were not present. The other capacitor of the CLC circuits is formed by making the common section 52 of transformer 51 a little larger in diameter than would be done if the CLC circuit were not needed.

In this way, two CLC circuits are formed—one for each branch—to minimize the effect of the standoff capacitance. These two circuits have the capacitance of common transformer section 52 in common, but separate inductors (53 and 54) and separate second capacitors—the standoff leg adjacent that branch's inner conductor 34 or 44, respectively.

Divider 14 splits power applied at common port 22 evenly between the two branch ports 32 and 42. Each of the three ports is designed to exhibit the same characteristic impedance ($Z_0$) at the operating frequency of this power divider. The channels 72, 73 and 74 all have the same cross-section. The relative sizes of the channels may be made different and the power division may be made unequal if desired, as may the characteristic impedances, all in accordance with well known principles of coaxial power dividers. See, for example, the references cited above.

The preferred embodiment provides a substantial improvement in coaxial transmission line power dividing networks because a split-tee, in accordance with this invention is capable of safely handling about 20 times the power that a similar divider 10 of FIG. 1 can handle. This is an increase in power of more than 13 dB. This increase in power handling capability is critical to the use of matched coaxial transmission line power dividers in phased array radars where its small size is important because of the large number of dividers needed for beam forming. This divider has an even-mode insertion loss of about 0.04 dB in the designed operating band of 3.1 GHz to 3.5 GHz. This low loss compares favorably with the even mode insertion loss of a divider 10 of FIG. 1. The divider 12 of FIG. 2 has essentially the same power handling capabilities as divider 14 of FIG. 3 does, but experiences an even mode insertion loss of about 0.14 dB.

While the difference of 0.1 dB in loss for the two structures does not, in itself, appear overly significant, the loss is at microwave frequencies where power generation is expensive. Further, this is the difference when a single split tee is utilized. When a number of split-tees are cascaded in order to divide source power among larger numbers of ultimate branch (output) ports, the saving of 0.1 dB per split becomes more significant. To divide one input line into sixteen output (branch) lines using a cascade of split-tees requires a series of four tees between the source or input line and each output line and to produce 32 separate outputs requires a cascade of five split-tees. Thus, the FIG. 3 embodiment's half a dB reduction in power loss (as compared to a FIG. 2 embodiment) in the series of divider networks has the double benefits of reducing the amount of drive power required to provide a given amount of power to the output (branch) ports and of increasing the total power which may be applied to the power division network without causing overheating of the odd mode resistors or breakdown of the surface leakage path along the heat sink.

Where the divider cascade is used in a phased array radar for forming both the transmitted beam and the received beam, the loss reduction is cumulative, i.e., 0.5 dB on transmission and 0.5 dB on reception which yields an overall loss reduction of 1 dB. Thus, the same maximum range can be obtained with 20% less transmitter power or the same transmitter power can yield an increase in range of about 3% as compared to divider 12 of FIG. 2.

Figure 4:
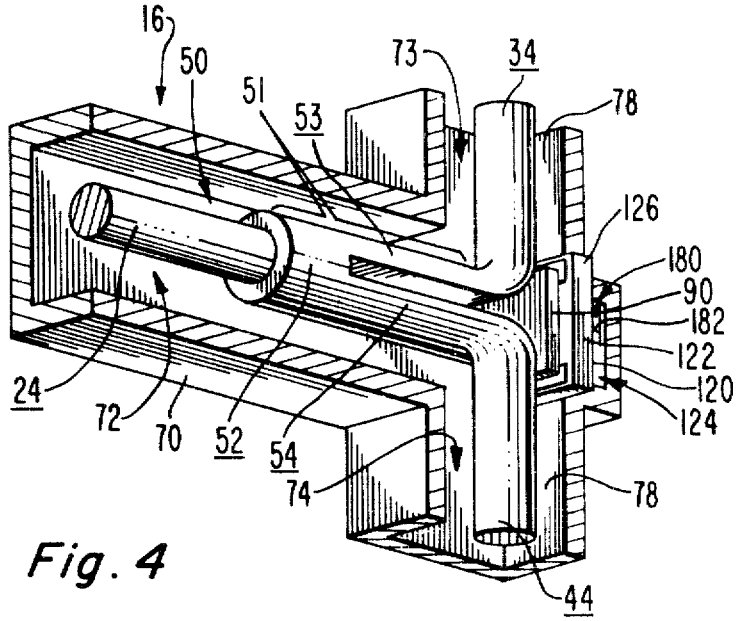
FIG. 4 is a perspective cutaway view of a low loss high-power coaxial transmission line split-tee power divider in accordance with an alternative embodiment of the present invention.

An alternative embodiment 16 of a coaxial power divider in accordance with the invention is illustrated in FIG. 4. Divider 16 is similar to divider 14 of FIG. 3 and the same reference numerals are used to identify corresponding portions of the device. The reference numerals for the heat sink and the alcove in the outer conductor are different because their shapes have changed although they are still configured to provide the low dielectric constant region (here region 124). Alcove 180 in divider 16 of FIG. 4 is shorter in the direction of the branch channels 73 and 74 than the alcove 80 of FIG. 3 is. Heat sink 120 of divider 16 of FIG. 4 is longer than heat sink 100 of divider 12 of FIG. 2 and lacks the arched shape of heat sink 110 of FIG. 3.

Heat sink 120 extends beyond the ends of alcove 180 and makes thermal contact with the face 78 of each of the branch channels. The low dielectric constant region 124 is provided by the depth of the alcove 180 and is preferably the same thickness as that of region 114 in FIG. 3.

This embodiment is not preferred because heat sink 120 has a shorter surface creepage path from branch inner conductors 34 and 44 to outer conductor 70 than heat sink 110 of FIG. 3 has. As a result, the maximum peak power which the structure 16 can handle without breakdown is less than that which structure 14 can handle, where the two couplers are otherwise dimensionally identical.

Figure 5:
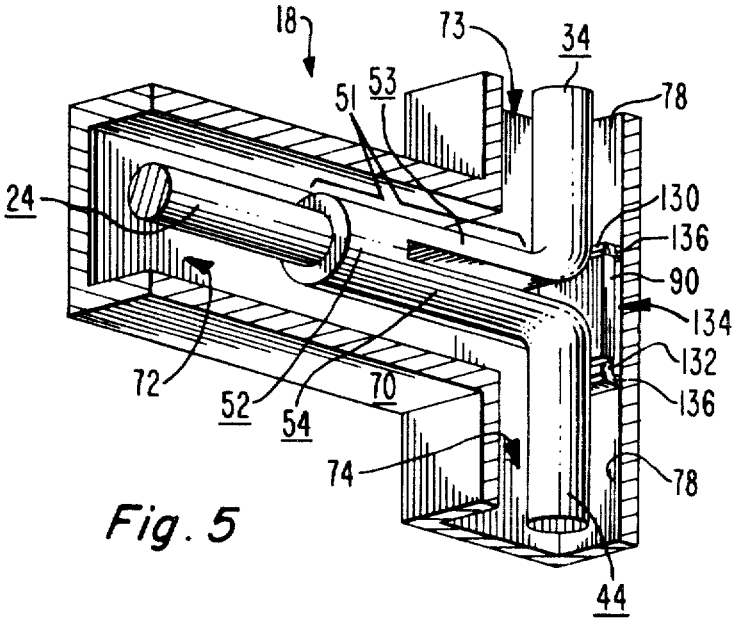
FIG. 5 is a perspective cutaway view of a high-power coaxial transmission line split-tee power divider in accordance with a further alternative embodiment of the present invention.

A further alternative embodiment 18 of a coaxial power divider in accordance with the invention is illustrated in FIG. 5. Divider 18 is similar to divider 12 of FIG. 2 with the exception of the heat sink 130 and the same reference numerals are used to identify corresponding portions of the structure other than heat sink 130. In divider 18 of FIG. 5, the heat sink 130 is arched similar to heat sink 110 of FIG. 3. However, there is no alcove in the outer conductor face 78. Therefore, the resistor contact portion 132 of the heat sink is thinner than in heat sink 110 (FIG. 3) to allow space for the low dielectric constant region 134. Standoffs 136 are shorter than standoffs 116 of FIG. 3. This embodiment is not preferred because it does not provide as great a capacitance reduction as divider 14 of FIG. 3 does, and suffers from the same peak power problems as divider 16 of FIG. 4 and heat sink 130 is structurally more fragile and a somewhat less effective heat conductor than heat sink 110 because of the thinner resistor contact portion 132.

Figure 6:
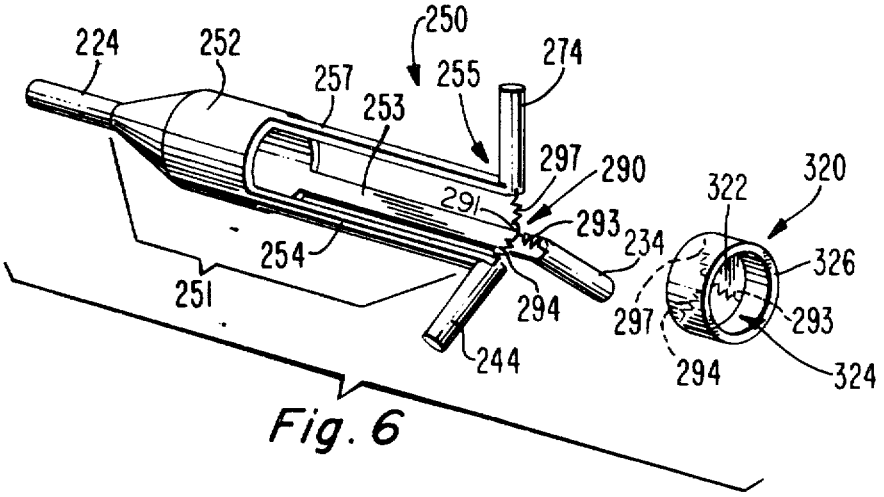
FIG. 6 illustrates an inner conductor and preferred heat sink configuration for a coaxial transmission line power divider having three branch ports.

This reduced capacitance heat sink technique may also be utilized with power dividers having more than two branch ports. An inner conductor system 250 for a three-branch-port power divider is illustrated in FIG. 6 along with an appropriate heat sink 320. The system 250 includes a common inner conductor 224, three branch inner conductors 234, 244 and 274 and an impedance transforming and isolation enabling section 251 which connects the common leg 224 to the three branch inner conductor legs 234, 244 and 274. Impedance transformer and isolation section 251 includes an enlarged comon section 252 at its common leg end and three splines 253, 254 and 257 which extend from the common section 252 to the transformer's branch end 255 where the splines 253, 254 and 257 become the branch inner conductors 234, 244 and 274, respectively.

An odd mode power dissipation resistive network 290 is connected to the inner conductor network at the junctures of the branch inner conductors 234, 244 and 274 with the inner conductor splines 253, 254 and 257. This resistor network has a common floating node 291 which is connected to the conductor 234 by a resistor 293, to the conductor 244 by a resistor 294 and to the conductor 274 by a resistor 297. As in the case of the structure of FIG. 3, no even mode power will flow through the resistor network 290 because the ends of the resistors 293, 294 and 297 in contact with the conductors 234, 244 and 274 will all be at the same potential for even mode power. However, odd mode power will be dissipated since any voltage difference between the ends of the resistors will cause a current to flow through the resistors.

In order that a high-power, low-loss network may result, the resistor network 290 is disposed on a heat sink structure 320 which is shown displaced from the inner conductor network 250 in the interest of drawing clarity. The locations of the individual resistors 293, 294 and 297 on the resistor contact portion 322 of the heat sink are shown in phantom. The resistor contact portion 322 is disk like. The disk 322 is spaced from the outer conductor, which is not shown, by a standoff portion 326 which is illustrated as being a substantially cylindrical shell. The shell 326 may be continuous as illustrated or may comprise a plurality of isolated longitudinal sections of such a shell. The standoff 326 and the disk 322 are preferably a single, continuous piece of a high thermal conductivity, electrically-insulating material such as BeO. Once again a low dielectric constant region (324) is provided between the resistor network or element and the outer conductor to minimize even mode displacement currents in the resistors of network 290.

A matched coaxial transmission line power divider heat sink structure which provides greatly increased power handling capacity for the divider without significantly increasing the losses or bulk of the structure has been illustrated and described as have a number of variations on that structure. As indicated, this heat sink is appropriate for use in dividers where the power is evenly split and where it is unevenly split and where the structure is used for power combining rather than power dividing. Additional transformer sections may be included in the branch legs and the common leg of the inner conductor system as needed to meet system design criteria. Those skilled in the art will be able to make further modifications in the preferred embodiment without departing from the scope of the invention as defined by the appended claims.

What is claimed is:

1. A coaxial transmission line coupling structure for connecting a common port to n branch ports where n is an integer greater than 1, said structure designed for operation over a predetermined frequency band, said structure comprising:

an inner conductor system including a common leg and n branch legs extending from a common junction with said common leg;

an n terminal resistance element for dissipating odd mode power and for isolating said n branch ports from each other, each of said n terminals connected to an associated branch leg at a distance from said common junction of approximately one quarter wavelength at a frequency in said band;

an outer conductor enclosing said inner conductor system;

a thermally conducting dielectric heat sink coupled between said resistance element and said outer conductor for conducting heat away from said resistance element; and said outer conductor and said heat sink being configured to form a region of a lower dielectric constant than said heat sink between said resistance element and said outer conductor to provide a lower capacitance between said resistance element and said outer conductor than would be provided in the absence of said lower dielectric constant region.

2. The coupling structure recited in claim 1 wherein said heat sink includes a standoff portion laterally displaced from said resistance element for forming said region of lower dielectric constant.

3. The coupling structure recited in claim 1 wherein a first portion of said heat sink directly contacts said outer conductor and a second portion of said heat sink is spaced from said outer conductor by said region of lower dielectric constant.

4. A coaxial transmission line coupling structure for connecting a common port to n branch ports where n is an integer greater than 1, said structure designed for operation over a predetermined frequency band, said structure comprising:

an inner conductor system including a common leg and n branch legs extending from a common junction with said common leg;

an n terminal resistance element for dissipating odd mode power and for isolating said n branch ports from each other, each of said n terminals connected to an associated branch leg at a distance from said common junction of approximately one quarter wavelength at a frequency in said band;

an outer conductor enclosing said inner conductor system;

a thermally conducting dielectric heat sink coupled between said resistance element and said outer conductor for conducting heat away from said resistance element; and at least one of said heat sink and said outer conductor having an alcove therein, said alcove having a lower dielectric constant than said heat sink, to form a low dielectric constant region between said resistance element and said outer conductor to provide a low capacitance therebetween while providing effective heat transfer from said resistance element to said outer conductor.

5. The coupling structure recited in claim 4 wherein said outer conductor includes an alcove disposed adjacent said resistance element to form said low dielectric constant region.

6. The coupling structure recited in claim 5 wherein said heat sink includes a standoff portion laterally displaced from said resistance element to form said low dielectric constant region.

7. The coupling structure recited in claim 6 wherein said standoff portion extends into said alcove in said outer conductor.

8. The coupling structure recited in claim 6 wherein said standoff portion is electrically insulating material.

9. The coupling structure recited in claim 4 or 5 wherein said heat sink includes an alcove therein to form said low dielectric constant region.

* * * * *